US009447763B2

(12) United States Patent
Eichenberger et al.

(10) Patent No.: US 9,447,763 B2
(45) Date of Patent: Sep. 20, 2016

(54) AIR-POWERED STARTER MOTOR

(71) Applicant: Ingersoll-Rand Company, Davidson, NC (US)

(72) Inventors: David Eichenberger, Sanford, NC (US); Michael Bookhout, Mooresville, NC (US); Matthew Pierce, Huntersville, NC (US); Brian Tietze, Mooresville, NC (US)

(73) Assignee: Ingersoll-Rand Company, Davidson, NC (US)

( * ) Notice: Subject to any disclaimer, the term of this patent is extended or adjusted under 35 U.S.C. 154(b) by 105 days.

(21) Appl. No.: 14/212,661

(22) Filed: Mar. 14, 2014

(65) Prior Publication Data

US 2014/0261274 A1 Sep. 18, 2014

Related U.S. Application Data

(60) Provisional application No. 61/798,566, filed on Mar. 15, 2013.

(51) Int. Cl.

| | |
|---|---|
| ***F02N 7/00*** | (2006.01) |
| ***F02N 7/08*** | (2006.01) |
| ***F02N 15/00*** | (2006.01) |
| *F02B 3/06* | (2006.01) |
| *F02N 7/06* | (2006.01) |
| *F02N 9/04* | (2006.01) |

(52) U.S. Cl.

CPC ..... *F02N 7/08* (2013.01); *F02N 15/006* (2013.01); *F02B 3/06* (2013.01); *F02N 7/00* (2013.01); *F02N 7/06* (2013.01); *F02N 9/04* (2013.01)

(58) Field of Classification Search

CPC ..... F02N 7/08; F02N 7/06; F02N 7/00; F02N 9/04; F02B 3/06

USPC ..... 123/179

See application file for complete search history.

(56) References Cited

U.S. PATENT DOCUMENTS

| | | | | |
|---|---|---|---|---|
| 4,044,550 | A | 8/1977 | Vermilye | |
| 4,273,085 | A | 6/1981 | Janik, Jr. | |
| 4,846,122 | A * | 7/1989 | Kristof et al. | 123/179.31 |
| 5,163,335 | A | 11/1992 | Isom | |
| 5,220,844 | A | 6/1993 | Mills | |
| 5,267,539 | A | 12/1993 | Becker et al. | |
| 5,743,140 | A | 4/1998 | Gustafson | |
| 5,796,172 | A | 8/1998 | Morisita et al. | |
| 5,847,471 | A | 12/1998 | Morishita et al. | |
| 7,013,651 | B2 | 3/2006 | Bruno et al. | |
| 2012/0001522 | A1 * | 1/2012 | Morris | H02K 5/128 310/68 B |

* cited by examiner

*Primary Examiner* — Lindsay Low
*Assistant Examiner* — Charles Brauch
(74) *Attorney, Agent, or Firm* — Taft Stettinius & Hollister LLP

(57) ABSTRACT

An adjustable air-powered starter motor that provides a plurality of different operational configurations. The air-powered starter motor includes a motor housing assembly that houses at least a portion of a rotary actuator assembly, and which may be connected to a cover assembly. The motor housing may be selectively attached to a mounting structure along first or second sides of the motor housing. Additionally, the motor housing may be attached to the mounting structure at a plurality of different angular orientations. The motor housing further includes an air inlet having first and second air inlet ports that are positioned on opposite sides of the motor housing, and an air outlet port that is positioned along a lateral axis that is generally parallel to, and offset from, a lateral axis of the inlet port. A mounting pin may align and interconnect the motor housing and rotary actuator assembly at each operational configuration.

21 Claims, 9 Drawing Sheets

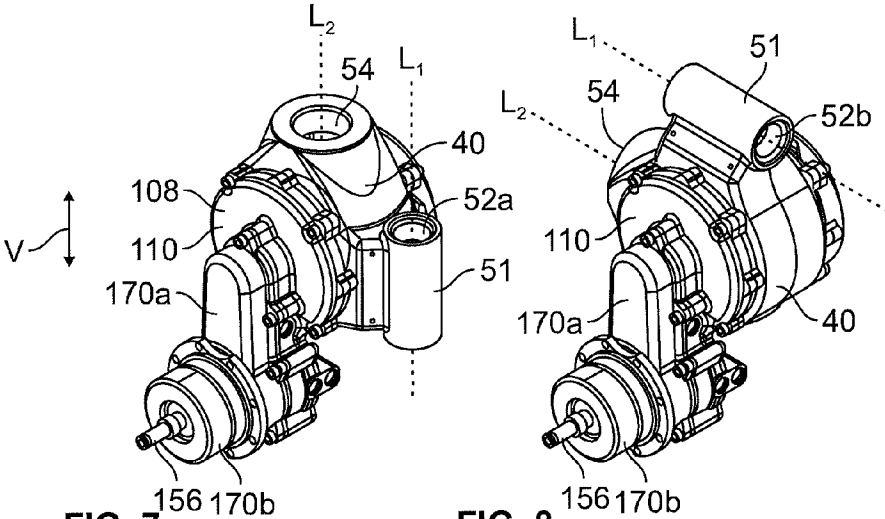
FIG. 7
FIG. 8
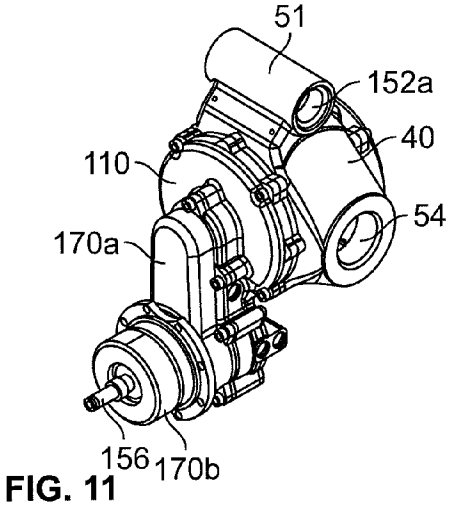
FIG. 11
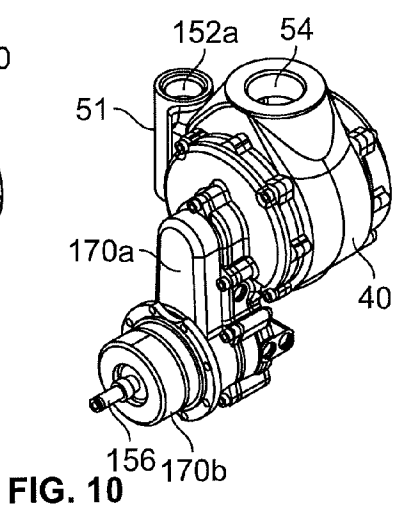
FIG. 10
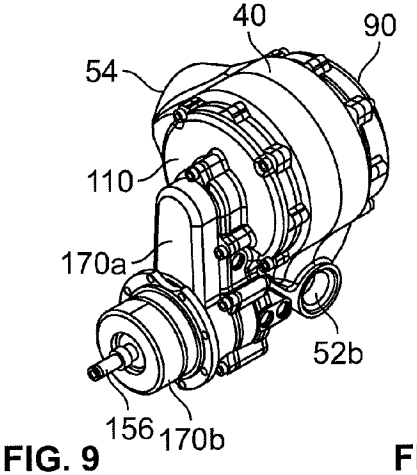
FIG. 9

AIR-POWERED STARTER MOTOR

RELATED APPLICATIONS

The present application claims the benefit of U.S. Provisional Patent Application Ser. No. 61/798,566, filed Mar. 15, 2013, which is incorporated herein by reference in its entirety.

BACKGROUND

Embodiments of the present invention generally relate to starter motor motors. More specifically, embodiments of the present invention relate to air-powered starter motors having adjustable configurations so as to be adaptable to a variety of different engine mounting orientations.

Air-powered starter motors are used on a wide variety of compression-type engines. Often, air-powered starter motors have an air operated rotary motor that is driven by pressurized gas from a fluid source that is in fluid communication with the starter motor. The pressurized gas, such as, for example, compressed air, may flow through at least a portion of the starter motor to facilitate rotary motion of the rotary motor. Further, in at least some applications, the gas that is exhausted from the starter motor must be captured so as to be delivered, via piping, to another location, or diffused by a separate assembly for noise reduction.

Air-powered starter motors are often operably mounted to a mounting member of an engine, such as, for example, a gear housing. However, engines often have different configurations. Such variances in engine configurations, and the inclusion of other accessories that are mounted to the engine, may result in the housing of the starter needing to be mounted at a variety of different angular positions/orientations relative to the mounting member. Yet, these various mounting positions/orientations often tend to increase the level of complexity, and cost, of the mounting arrangements for the starter motor. For example, a number of additional parts are often needed to adapt the existing starter motor configuration to the various, different mounting orientations. Additionally, changes in starter motor mounting orientations often also increases the complexity of connecting the starter motor to the supply and outlet lines that deliver or remove the gas that is used in the operation of the starter motor.

SUMMARY

An aspect of the present invention is an air-powered starter motor that includes a motor housing that has a sidewall, a first side, and a second side, the sidewall generally defining an interior region of the motor housing. The air-powered starter motor also includes an air motor that is positioned within the interior region and which is mounted for rotation about a rotational axis. Additionally, the air-powered starter motor includes a mounting structure that is configured for selective attachment to either the first or second side of the motor housing. The air-powered starter motor also has a first operational configuration in which the mounting structure is attached to the first side of the motor housing, and a second operational configuration in which the mounting structure is attached to the second side of the motor housing.

Another aspect of the present invention is an air-powered starter motor that includes a motor housing having a sidewall, a first side, and a second side, the sidewall generally defining an interior region of the motor housing. The air-powered starter motor further includes an air motor that is positioned within the interior region of the motor housing, and is mounted for rotation about a rotational axis. The motor housing is configured for adjustable, selective attachment to a mounting structure at a plurality of different angular orientations relative to the rotational axis. Thus, the air-powered starter motor has a plurality of operational configurations, with the angular orientation at which the motor housing is attached to the mounting structure being different for each of the plurality of operational configurations.

Another aspect of the present invention is an air-powered starter motor that has a motor housing that has a sidewall, a first side, and a second side, the sidewall generally defining an interior region of the motor housing. The air-powered starter motor also includes a rotary actuator assembly that has a rotary air motor, an air motor liner, and a mounting pin. The air motor liner includes a sidewall that is for placement of the air motor liner within the interior region of the motor housing, and for the air motor liner to receive the insertion of at least a portion of the rotary air motor. Additionally, the sidewall of the air motor liner has a plurality of openings. Further, the rotary air motor is configured for rotation about a rotational axis. Additionally, the motor housing is configured for adjustable, selective attachment to a mounting structure at a plurality of angular orientations relative to the rotational axis. Therefore, the air-powered starter motor has a plurality of operational configurations, the angular orientation at which the motor housing is attached to the mounting structure being different for each of the plurality of operational configurations. Further, the mounting pin is configured to align and interconnect the rotary actuator assembly with the mounting structure for each of the plurality of operational configurations.

Other aspects of the present invention will become apparent by consideration of the detailed description and accompanying drawings.

BRIEF DESCRIPTION OF THE DRAWINGS

FIG. 7 illustrates a perspective view of the air-powered starter motor assembly shown in FIG. 1 in another mounting configuration.

FIG. 8 illustrates a perspective view of another mounting configuration of the air-powered starter motor assembly shown in FIG. 1.

FIG. 9 illustrates a perspective view of a mounting configuration of the air-powered starter motor in which the motor housing is in a second side position.

FIG. 10 illustrates a perspective view of another mounting configuration of the air-powered starter motor assembly shown in FIG. 9.

FIG. 11 illustrates a perspective view of another mounting configuration of the air-powered starter motor assembly shown in FIG. 9.

Figure 1:
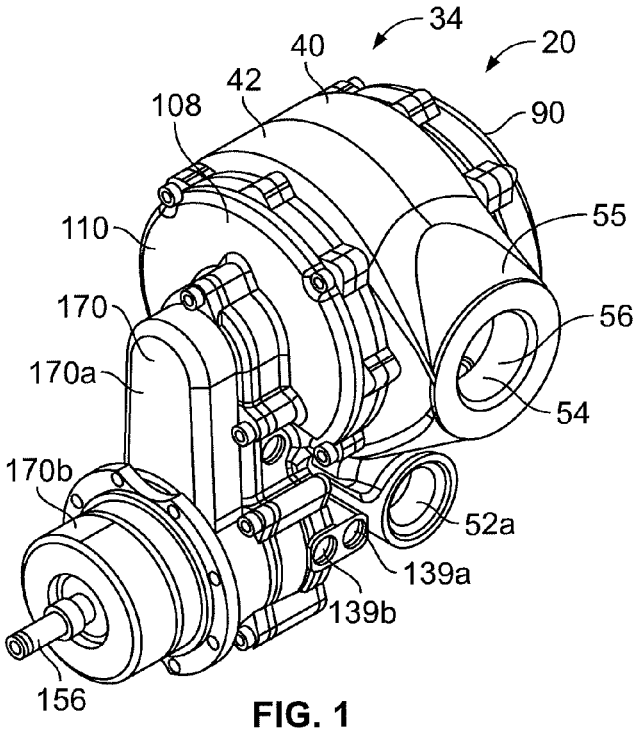
FIG. 1 illustrates a perspective view of an air-powered starter motor assembly with a motor housing in a first side position according to an illustrated embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED OF THE ILLUSTRATED EMBODIMENTS

Figure 2:
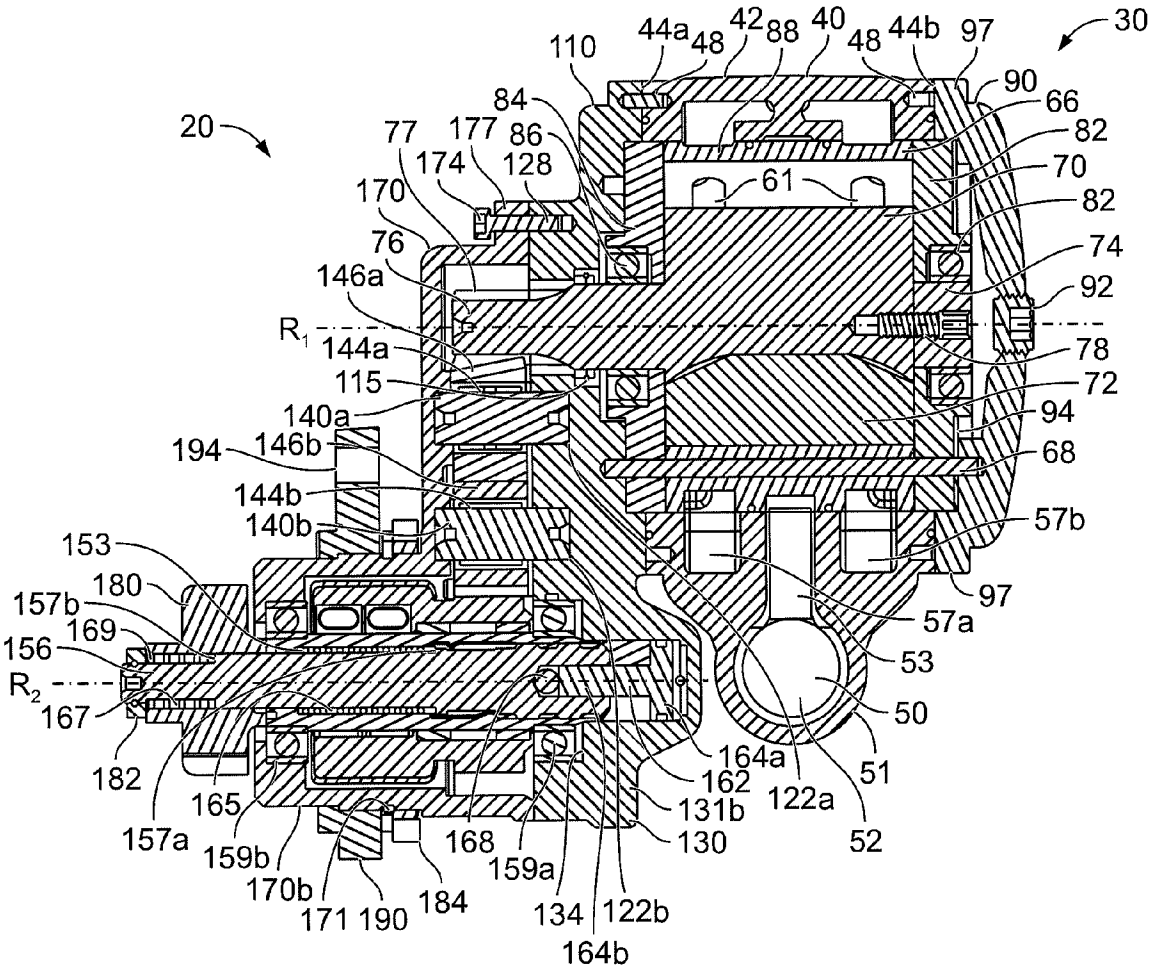
FIG. 2 illustrates a vertical sectional view of the air-powered starter motor assembly shown in FIG. 1.

FIGS. 1 and 2 illustrate an air-powered starter motor 20 according to an illustrated embodiment of the invention. It should be understood that the air-powered starter motor 20 may also be referred to as a gaseous fluid-powered starter, a gas-powered starter, a fluid-powered starter, an air starter, an air-powered cranking motor, among other terms. The air-powered starter motor 20 is driven by a pressurized gaseous fluid and is configured to facilitate the starting of an engine. Moreover, according to certain embodiments, the air-powered starter motor 20 is configured for interconnection with a compression engine, such as, for example, a gasoline or diesel engine. However, it should be understood that the air-powered starter motor 20 may be used in association with a variety of other types of engines.

Referencing FIGS. 3A-3G, according to certain embodiments, the air-powered starter motor 20 generally includes an air motor assembly 22, a power transmission assembly 24, and an engine interface assembly 26. The power transmission assembly 24 may be operably attached to the air motor assembly 22. Further, the engine interface assembly 26 is configured to interconnect the power transmission assembly 24 with the engine (not shown). According to certain embodiments, the air motor assembly 22 is configured to generate rotational torque along a first rotational axis $R_1$, and the power transmission assembly 24 is configured to transmit the rotational torque from the air motor assembly 22 to a second rotational axis $R_2$ that is arranged substantially parallel with, and offset from, the first rotational axis $R_1$.

Although a particular configuration of the air-powered starter motor 20 is illustrated and described herein, it should be understood that other configurations are also contemplated. For example, according to certain embodiments, the air-powered starter motor 20 does not include a power transmission assembly 24 such that the air motor assembly 22 is mounted to the engine via the engine interface assembly 26. Further, according to certain embodiments, the air-powered starter motor 20 does not include an engine interface assembly 26 such that the air motor assembly 22 is mounted to the engine via the power transmission assembly 24. Additionally, according to other embodiments, the air-powered starter motor 20 does not include a power transmission assembly 24 or an engine interface assembly 26 such that the air motor assembly 22 is mounted directly to the engine.

In the illustrated embodiment, the air motor assembly 22 generally includes a motor housing assembly 30, a rotary actuator assembly 32, and a closure or cover assembly 34. Although a particular type and configuration of the air motor assembly 22 is illustrated and described herein, it should be understood that other types and configurations of air motor assemblies are also contemplated.

Figure 4:
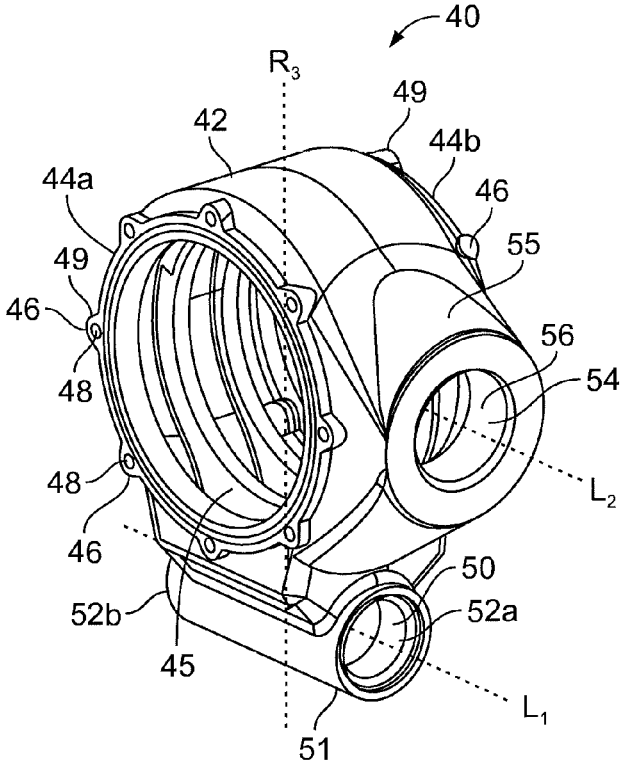
FIG. 4 illustrates an enlarged perspective view of the motor housing shown in FIG. 3A.
Figure 3A:
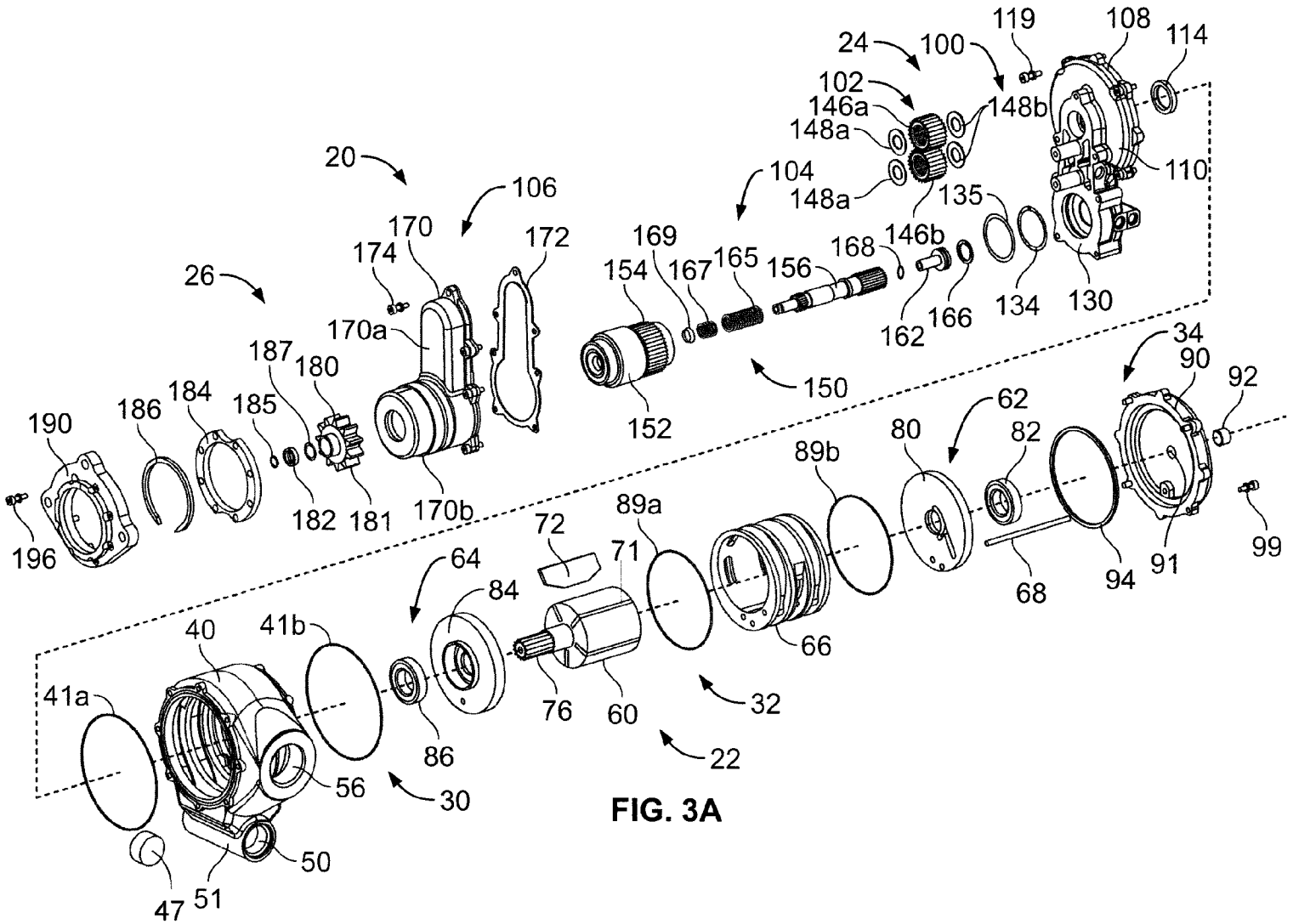
FIG. 3A illustrates an exploded perspective view of the air-powered starter motor assembly shown in FIG. 1.
Figure 3D:
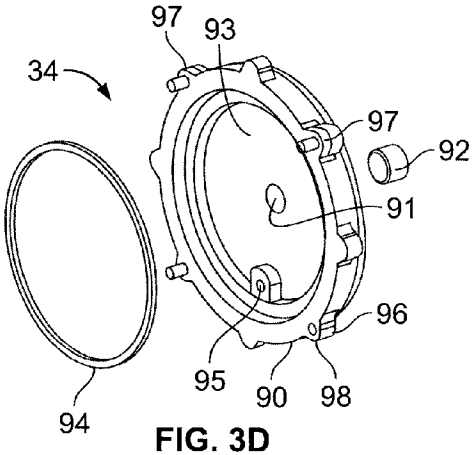
FIG. 3D illustrates an enlarged perspective view of the cover assembly shown in FIG. 3A.
Figure 3B:
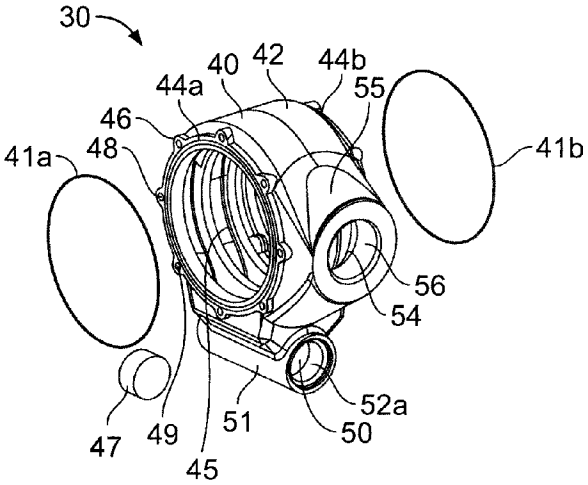
FIG. 3B illustrates an enlarged perspective view of the motor housing assembly shown in FIG. 3A.

As shown by at least FIGS. 3A, 3B, and 4, in the illustrated embodiment, the motor housing assembly 30 generally includes a monolithic, single-piece motor housing 40 and a pair of seals or O-rings 41*a*, 41*b* that provide sealing engagements between the motor housing 40 and the transmission assembly 24 and between the motor housing 40 and the cover assembly 34. According to certain embodiments, the motor housing 40 has a generally cylindrical configuration. In the illustrated embodiment, the motor housing 40 includes a circumferential side wall 42 that extends annularly about the first rotational axis $R_1$, first and second sides or faces 44*a*, 44*b* positioned on opposite sides of the housing 40, and a generally hollow interior region 45 that generally extends along the first rotational axis $R_1$ from the first side 44*a* to the opposite second side 44*b*. Additionally, each of the first and second sides 44*a*, 44*b* include a number of attachment locations or nodes 46 spaced peripherally relative to the side wall 42, and which are configured to attach the motor housing 40 to an adjacent structure. According to certain embodiments, the attachment locations 46 each include an opening or aperture 48 that is sized to receive a pin, screw or fastener therethrough for attachment of the motor housing 40 to an adjacent structure, as described below. Additionally, in a further embodiment, each of the attachment locations 46 includes a radial flange or projection 49 that extends radially outward from the side wall 42, and which defines one of the openings 48. According to certain embodiments, the openings 48 are internally threaded for engagement with a threaded screw or fastener. Further, in the illustrated embodiment, each of the first and second sides 44*a*, 44*b* of the motor housing 40 includes four attachment locations 46. However, it should be understood that the first and second sides 44*a*, 44*b* of the motor housing 40 may be provided with any number of attachment locations 46 that are arranged about the first and/or second sides 44*a*, 44*b* in a variety of different patterns or configurations.

The motor housing 40 further includes an air inlet or supply 50 and an air outlet or exhaust 54, each positioned in fluid communication with the interior region 45. As shown in FIG. 4, in the illustrated embodiment, the air inlet 50 is arranged generally along a first lateral axis $L_1$ that generally extends tangential to the circumferential side wall 42 of the motor housing 40. Additionally, the air inlet 50 includes a pair of air inlet ports 52*a*, 52*b* that are positioned along the first lateral axis $L_1$ on opposing sides of the motor housing 40. According to certain embodiments, the air inlet ports 52*a*, 52*b* are defined by a cylindrical-shaped sleeve 51 that is positioned along the first lateral axis $L_1$. The air inlet ports 52*a*, 52*b* are in fluid communication with the interior region 45 of the motor housing 40 via a centrally-located air inlet passage 53 that, according to the illustrated embodiment, generally extends in a radial direction.

According to certain embodiments, the air inlet ports 52*a*, 52*b* may configured for a mating engagement with a supply line or pipe that provides pressurized gas to the motor housing 40 from a fluid source. For example, according to certain embodiments, the air inlet ports 52*a*, 52*b* may include an internal or external thread that is configured to mate a threaded connector or fitting of a gas supply line. Further, according to certain uses and/or positional orientations of the motor housing 40, one of the air inlet ports 52*a*, 52*b* may be blocked, sealed, or otherwise covered by a plug 47 so as to prevent gas from passing through that particular air inlet port 52*a*, 52*b*.

As shown by at least FIG. 4, in the illustrated embodiment, the air outlet 54 is arranged generally along a second lateral axis $L_2$ and includes a single air outlet port or opening 56. Further, the outlet port 56 is positioned along the second lateral axis $L_2$ and arranged generally parallel to the first lateral axis $L_1$ and the air inlet ports 52*a*, 52*b*. According to certain embodiments, the air outlet port 56 is defined by a cylindrical-shaped sleeve 55 that is positioned along the second lateral axis $L_2$ and extends generally along a radial dimension of the motor housing 40 in a direction generally perpendicular to, and intersecting, the rotational axis $R_1$. The air outlet port 56 is in fluid communication with the interior region 45 of the motor housing 40 via a pair of outlet passages 57*a*, 57*b* that are arranged on opposite sides of the air inlet passage 53 and which extend circumferentially about the side wall 42 relative to the rotational axis $R_1$. Further, according to certain embodiments, the air outlet port 56 may be configured for a mating engagement with an exhaust line or pipe that removes gas from the starter motor 20. For example, according to certain embodiments, the air outlet port 56 may include an internal or external thread that is configured to mate a threaded connector or fitting of an exhaust line.

Although a particular type and configuration of the motor housing assembly 30 is illustrated and described herein, it should be understood that other types and configurations of motor housing assemblies are also contemplated for use in association with the air-powered starter motor 20.

Figure 3C:
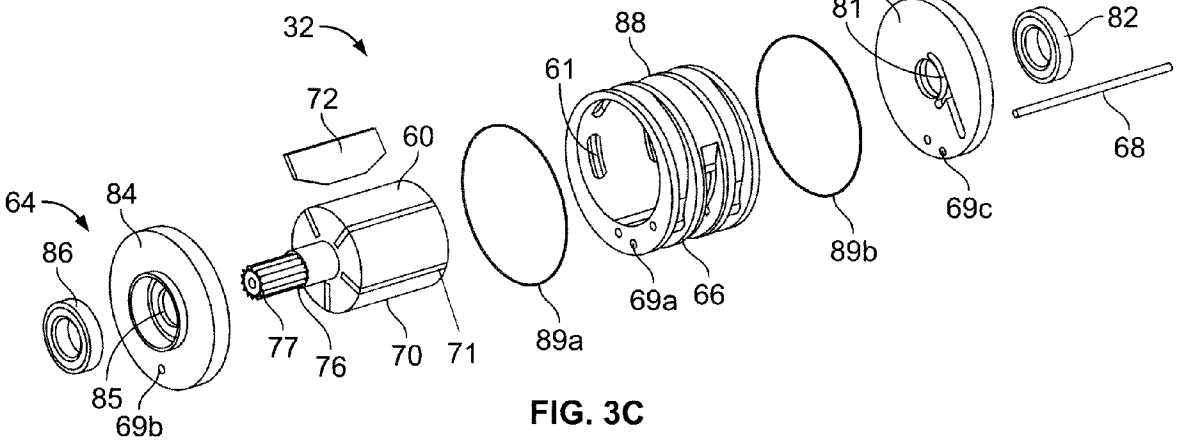
FIG. 3C illustrates an enlarged perspective view of the rotary actuator assembly shown in FIG. 3A.

As shown by at least FIGS. 2, 3A, and 3C, in the illustrated embodiment, the rotary actuator assembly 32 generally includes a rotary air motor 60 that is configured for rotational movement within the motor housing 40 about the first rotational axis $R_1$, a first bearing assembly 62 for rotationally supporting a first end of the rotary air motor 60, a second bearing assembly 64 for rotationally supporting a second end of the rotary air motor 60, a stationary air motor liner or sleeve 66 sized to receive the air motor 60 therein, and a fastener or mounting pin 68 which servers to interconnect the first and second motor bearing assemblies 62, 64 with the air motor liner 66 and to mount the rotary actuator assembly 32 to the power transmission assembly 24.

In the illustrated embodiment, the rotary air motor 60 is of the vane type and includes a generally circular-shaped hub 70, a plurality of vanes 72 slidably mounted in radially-extending slots 71 defined in the hub 70, a bearing stem 74 extending axially from a first end of the hub 70 and arranged generally along the rotational axis $R_1$, an output drive shaft 76 extending axially from a second end of the hub 70 generally along the rotational axis $R_1$ and including a number of gear teeth or splines 77 extending radially therefrom, and a screw or threaded pin 78 extending into a central opening in the hub 70. In the illustrated embodiment, the rotary air motor 60 includes a five radial vanes 72 spaced uniformly relative to the rotational axis $R_1$. However, it should be appreciated that the rotary air motor 60 may include any number of vanes 72 spaced uniformly or non-uniformly relative to the rotational axis $R_1$.

The first bearing assembly 62 generally includes a first end plate 80, a shaft bearing 82 extending about the bearing stem 74 and positioned within a recess or cavity 81 in the first end plate 80, and a C-shaped snap ring or clip for maintaining the shaft bearing 82 in position relative to the first end plate 80. Similarly, the second bearing assembly 64 generally includes a second end plate 84, a shaft bearing 86 extending about the output drive shaft 76 and positioned within a recess or cavity 85 in the first end plate 80, and a C-shaped snap ring or clip for maintaining the shaft bearing 86 in position relative to the second end plate 84.

The air motor liner 66 has a generally cylindrical wall 88 defining an external cross section sized for receipt within the interior region 45 of the motor housing 40 and an internal cross section sized for receipt of the air motor 60 therein. The air motor liner 66 includes a number of radial openings or passages 61 extending through the cylindrical wall 88 which are aligned with the air inlet passage 53 and the air outlet passages 57*a*, 57*b* in the motor housing 40. One or more of the openings 61 allow for pressurized gas from the inlet passage 53 in the motor housing 40 to flow into the air motor liner 66 so that the pressurized gas may provide the motive force to rotate the air motor 60 about the rotational axis $R_1$. Further, one or more other openings 61 allow for expanded gas to be exhausted from the air motor 60 through the outlet passages 57*a*, 57*b* in the motor housing 40 so as to vent the expanded gas from the air motor 60. The air motor liner 66 further includes a pair of seals or O-rings 89*a*, 89*b* that are used in providing a sealing engagement between the circumferential side wall 42 of the motor housing 40 and a central region of the cylindrical wall 88 of the motor liner 66.

The mounting pin 68 extends through aligned openings 69*a-c* in the air motor liner 66 and the first and second first end plates 80, 84 to interconnect the liner 66 and the end plates 80, 84. The mounting pin 68 is also positioned within recesses or indentations formed in the power transmission assembly 24 and the cover assembly 34 to mount the rotary actuator assembly 32 to the power transmission assembly 24 and the cover assembly 34 and to maintain proper alignment of the air motor liner 66 relative to the motor housing 40.

Although a particular type and configuration of the rotary actuator assembly 32 is illustrated and described herein, it should be understood that other types and configurations of rotary actuator assemblies are also contemplated for use in association with the air-powered starter motor 20.

As shown by at least FIGS. 3A and 3D, in the illustrated embodiment, the closure or cover assembly 34 generally includes an end cover 90 and a plug 92 that is configured to be positioned within a central opening 91 in the end cover 90, and a seal or O-ring 94 that is configured to provide a sealing engagement between the end cover 90 and the first end plate 80. The end cover 90 further includes a recess or indentation 95 formed along or about an inner surface 93 of the cover plate 90 that is sized for receipt of an end portion of the mounting pin 68 therein to mount the rotary actuator assembly 32 to the cover assembly 34 and to properly align the rotary actuator assembly 32 relative to the end cover 90. Additionally, the end cover 90 includes a number of attachment locations or nodes 96 spaced about an outer periphery of the end cover 90 which are alignable with, and attachable to, the attachment locations 46 defined by one of the first and second sides 44*a*, 44*b* of the motor housing 40. According to certain embodiments, the attachment locations 96 each include a through opening or aperture 98 sized to receive a pin, screw or fastener 99 therethrough that engage the openings 48 defined by the attachment locations 46 of the motor housing 40 to securely attach the end cover 90 to the motor housing 40. In a further embodiment, each of the attachment locations 96 includes a radial flange or projection 97 that extends radially outward from the end cover 90 and which define one of the openings 98. In the illustrated embodiment, the end cover 90 includes four attachment locations 96. However, it should be understood that the end cover 90 may be provided with any number of attachment locations 96.

Although a particular configuration of the attachment locations 96 is illustrated and described herein, it should be understood that other types and configurations of attachment locations are also contemplated for use in association with the end cover 90. Additionally, although a particular type and configuration of the closure or cover assembly 34 is illustrated and described herein, it should be understood that other types and configurations of cover assemblies are also contemplated for use in association with the air-powered starter motor 20.

In the illustrated embodiment, the power transmission assembly 24 generally includes a mounting plate assembly 100, a gear drive assembly 102, a spindle assembly 104, and a power transmission housing assembly 106. Although a particular type and configuration of the power transmission assembly 24 is illustrated and described herein, it should be understood that other types and configurations of power transmission assemblies are also contemplated for use in association with the air-powered starter motor 20.

As shown by at least FIGS. 3A, 3E, 5, and 6, in the illustrated embodiment, the mounting plate assembly 100 includes a mounting plate 108 having a first mounting plate portion 110 and a second mounting plate portion 130. The first mounting plate portion 110 is arranged generally along the first rotational axis $R_1$ and is configured for selective engagement with the motor housing 40 in a plurality of operational rotational positions/orientations. The second mounting plate portion 130 is arranged generally along the second rotational axis $R_2$ and is configured for engagement with the spindle assembly 104 and the power transmission housing assembly 106. According to certain embodiments, the first and second mounting plate portions 110, 130 are formed integral with one another to provide the mounting plate 108 as a single-piece monolithic structure. However, other non-monolithic configurations are also contemplated.

The first mounting plate portion 110 includes opposite first and second sides 111*a*, 111*b* and an opening 112 extending along the first rotational axis $R_1$ from the first side 111*a* to the second side 111*b*. The opening 112 is sized and configured for receipt of the output drive shaft 76 of the air motor 60 therethrough. An annular seal 114 is positioned within a groove 115 formed in the first side 111*a* and surrounding the opening 112 to provide a sealing engagement between the first mounting plate portion 110 and the output drive shaft 76. Additionally, the first mounting plate portion 110 includes a number of attachment locations or nodes 116, as shown by at least FIGS. 5 and 6, that are spaced about an outer periphery thereof and which are alignable with, and attachable to, the attachment locations 46 defined by the first and second sides 44*a*, 44*b* of the motor housing 40. According to certain embodiments, the attachment locations 116 each include a through opening or aperture 118 sized to receive a pin, screw or fastener 119 therethrough and which engages the openings 48 defined by the attachment locations 46 of the motor housing 40 to securely attach the first mounting plate portion 110, and thus the mounting plate assembly 100, to the motor housing 40. In a further embodiment, each of the attachment locations 116 includes a radial flange or projection 117 that extends radially outward from the first mounting plate portion 110, each defining one of the openings 118. In the illustrated embodiment, the first mounting plate portion 110 includes four attachment locations 116. However, it should be understood that the first mounting plate portion 110 may be provided with any number of attachment locations 116. Additionally, although a particular configuration of the attachment locations 116 is illustrated and described herein, it should be understood that other types and configurations of attachment locations 116 are also contemplated for use in association with the first mounting plate portion 110.

The first mounting plate portion 110 also includes a number of recesses or indentations 120 (FIG. 6) formed in the first side 111*a* and radially offset from the first rotational axis $R_1$. The recesses 120 are sized for receipt of an end portion of the mounting pin 68 therein to mount the rotary actuator assembly 32 to the mounting plate assembly 100 and to properly align the rotary actuator assembly 32 relative to the mounting plate assembly 100. In the illustrated embodiment, the first mounting plate portion 110 includes four recesses 120 spaced uniformly about the first rotational axis $R_1$. However, it should be understood that the first mounting plate portion 110 may be provided with any number of recesses 120. As should be appreciated, in the illustrated embodiment, the rotary actuator assembly 32 may be positioned at a number of different angular orientations relative to the mounting plate assembly 100, with the end portion of the mounting pin 68 in a select one of the recesses 120.

Additionally, according to certain embodiments, the first mounting plate portion 110 includes a pair of recesses or indentations 122*a*, 122*b* (FIG. 2) formed in the second side 111*b* and positioned between the first and second rotational axes $R_1$ and $R_2$. The pair of recesses/indentations 122*a*, 122*b* are each sized for receipt of a bearing shaft associated with the gear drive assembly 102, as discussed below in more detail.

The first mounting plate portion 110 further includes a number of attachment locations or nodes 126 (FIG. 5) formed in the second side 111*b* and spaced about the opening 112. The attachment locations 126 are alignable with, and attachable to, corresponding attachment locations or nodes defined by the power transmission housing assembly 106 to securely attach the power transmission housing assembly 106 to the mounting plate assembly 100. According to certain embodiments, the attachment locations 126 each include a blind opening or aperture 128 sized to threadingly receive a pin, screw or fastener extending from the power transmission housing assembly 106 to securely attach the power transmission housing assembly 106 to the mounting plate assembly 100. In a further embodiment, each of the attachment locations 126 includes a radial flange or projection 127 defining one of the openings 128. In the illustrated embodiment, the first mounting plate portion 110 includes three attachment locations 126. However, it should be understood that the first mounting plate portion 110 may be provided with any number of attachment locations 126. Additionally, although a particular configuration of the attachment locations 126 is illustrated and described herein, it should be understood that other types and configurations of attachment locations 126 are also contemplated for use in association with the first mounting plate portion 110.

The second mounting plate portion 130 includes opposite first and second sides 131*a*, 131*b* and a blind opening 132 extending along the second rotational axis $R_2$ from the second side 131*b* and toward the first side 131*a*. The blind opening 132 is sized and configured for receipt of an end portion of the spindle assembly 104 therein, as further discussed below. A shaft bearing 134 is positioned within an enlarged counterbore portion of the blind opening 132. The shaft bearing 134 is sized for receipt of an end portion of a spindle drive shaft therein to support the spindle drive shaft for rotation about the second rotational axis $R_2$. Additionally, an O-ring or C-shaped snap ring 135 extends about the outer perimeter of the shaft bearing 134 to provide a sealing engagement between the shaft bearing 134 and the second mounting plate portion 130 and/or to secure the shaft bearing 134 in position relative to the second mounting plate portion 130.

The second mounting plate portion 130 further includes a number of attachment locations or nodes 136 (FIG. 5) formed in the second side 131*b* and spaced about the opening 132. The attachment locations 136 are alignable with, and attachable to, corresponding attachment locations or nodes defined by the power transmission housing assembly 106 to securely attach the power transmission housing assembly 106 to the mounting plate assembly 100. According to certain embodiments, the attachment locations 136 each include a blind opening or aperture 138 sized to threadingly receive a pin, screw or fastener extending from the power transmission housing assembly 106 to securely attach the power transmission housing assembly 106 to the mounting plate assembly 100. In a further embodiment, each of the attachment locations 136 includes a radial flange or projection 137 defining one of the openings 138. In the illustrated embodiment, the second mounting plate portion 130 includes four attachment locations 136 spaced uniformly about the opening 132. However, it should be understood that the second mounting plate portion 130 may be provided with any number of attachment locations 136. Additionally, although a particular configuration of the attachment locations 136 is illustrated and described herein, it should be understood that other types and configurations of attachment locations 136 are also contemplated for use in association with the second mounting plate portion 130.

Although a particular type and configuration of the mounting plate assembly 100 is illustrated and described herein, it should be understood that other types and configurations of mounting plate assemblies are also contemplated for use in association with the air-powered starter motor 20.

Figure 3E:
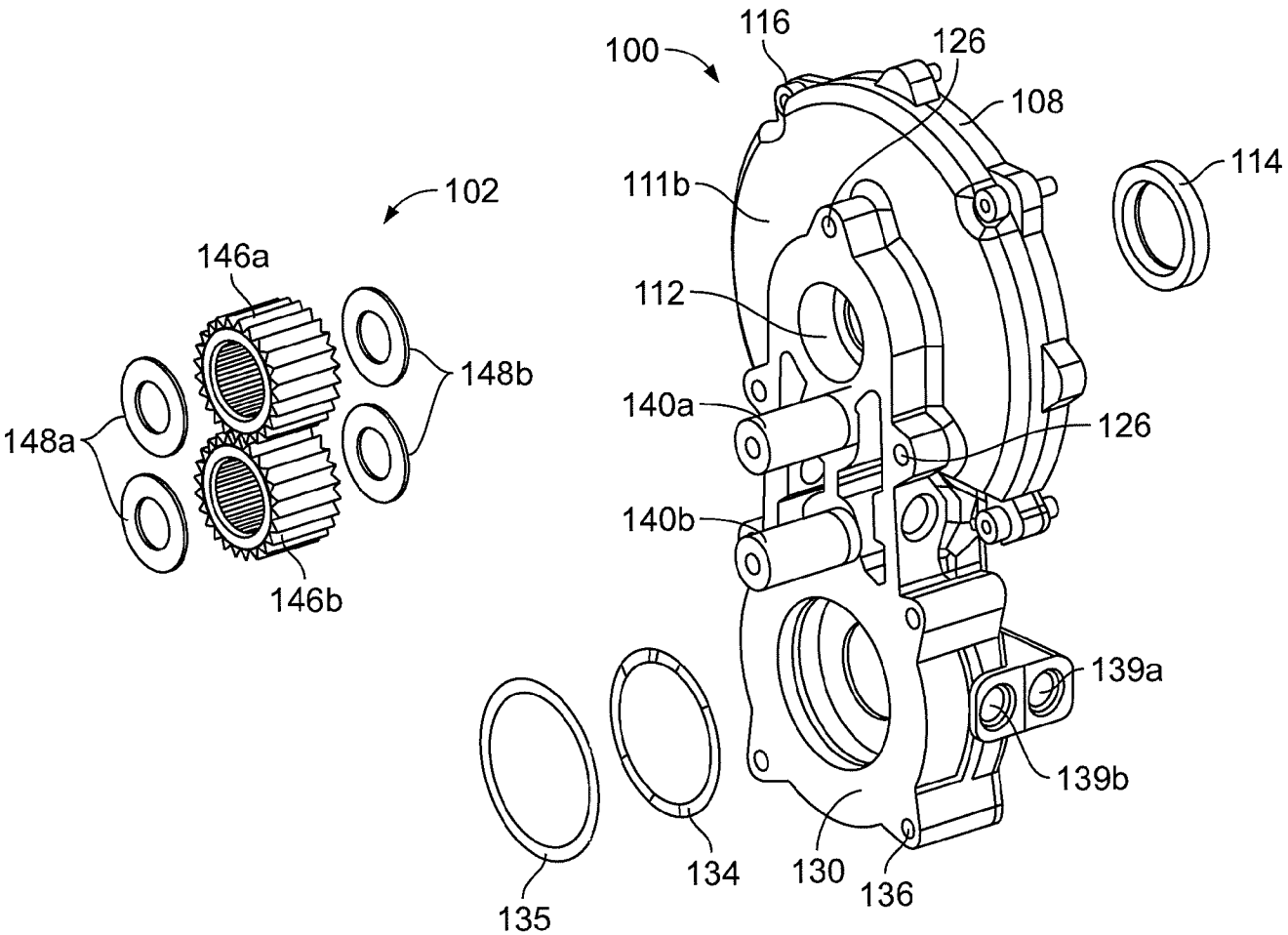
FIG. 3E illustrates an enlarged perspective view of the mounting plate and gear drive assemblies shown in FIG. 3A.

As shown by at least FIGS. 2, 3A, and 3E, in the illustrated embodiment, the gear drive assembly 102 generally includes a pair of gear mounting pins or shafts 140*a*, 140*b*, a pair of shaft bearings 144*a*, 144*b* positioned about the gear mounting pins 140*a*, 140*b*, a pair of multi-tooth gears 146*a*, 146*b* positioned about the bearings 144*a*, 144*b*, and a pair of washers, O-rings, or seals 148*a*, 148*b* positioned on opposite sides of each of the shaft bearings 144*a*, 144*b*. The gear mounting pins 140*a*, 140*b* may be part of, or operably connected to, the mounting plate 108. For example, according to certain embodiments, the gear mounting pins 140*a*, 140*b* are secured to the mounting plate 108 by a mechanical fastener, such as, for example, setscrews or fasteners, which threadingly engage laterally-extending threaded openings in the mounting plate 108. Further, according to the illustrated embodiment, a first end of the mounting pins 140*a*, 140*b* are positioned within a circular recess or indentation defined in the first side 111*a* of the first mounting plate portion 110, and an opposite second end of the mounting pins 140*a*, 140*b* is positioned within a circular recess or indentation defined in an inner side of the power transmission housing assembly 106.

In the illustrated embodiment, the multi-tooth gear 146*a* is intermeshingly engaged with the gear teeth 77 defined by the output drive shaft 76 of the rotary air motor 60, the multi-tooth gear 146*a* is intermeshingly engaged with the multi-tooth gear 146*b*, and the multi-tooth gear 146*b* is intermeshingly engaged with the gear teeth 152 defined about the outer perimeter of the spindle assembly 104. Accordingly, the gear drive assembly 102 transmits rotational movement or torque generated by the rotary air motor 60 about the first rotational axis $R_1$ to rotational movement or torque of the spindle assembly 104 about the second rotational axis $R_2$. In the illustrated embodiment, the rotational speed of the spindle assembly 104 is reduced relative to the rotary air motor 60 along with a corresponding increase in torque of the spindle assembly 104 relative to the rotary air motor 60. However, it should be understood that a gear reduction ratio need not be provided between the rotary air motor 60 and the spindle assembly 104. In other embodiments, the air-powered starter motor 20 need not include the gear drive assembly 102. Instead, the rotary air motor 60 may be directly engaged with the spindle assembly 104. In still other embodiments, the air-powered starter motor 20 need not include the spindle assembly 104. Instead, the rotary air motor 60 may be directly engaged to the engine via the engine interface assembly 26.

Although a particular type and configuration of the gear drive assembly 102 is illustrated and described herein, it should be understood that other types and configurations of gear drive assemblies are also contemplated for use in association with the air-powered starter motor 20.

Figure 3F:
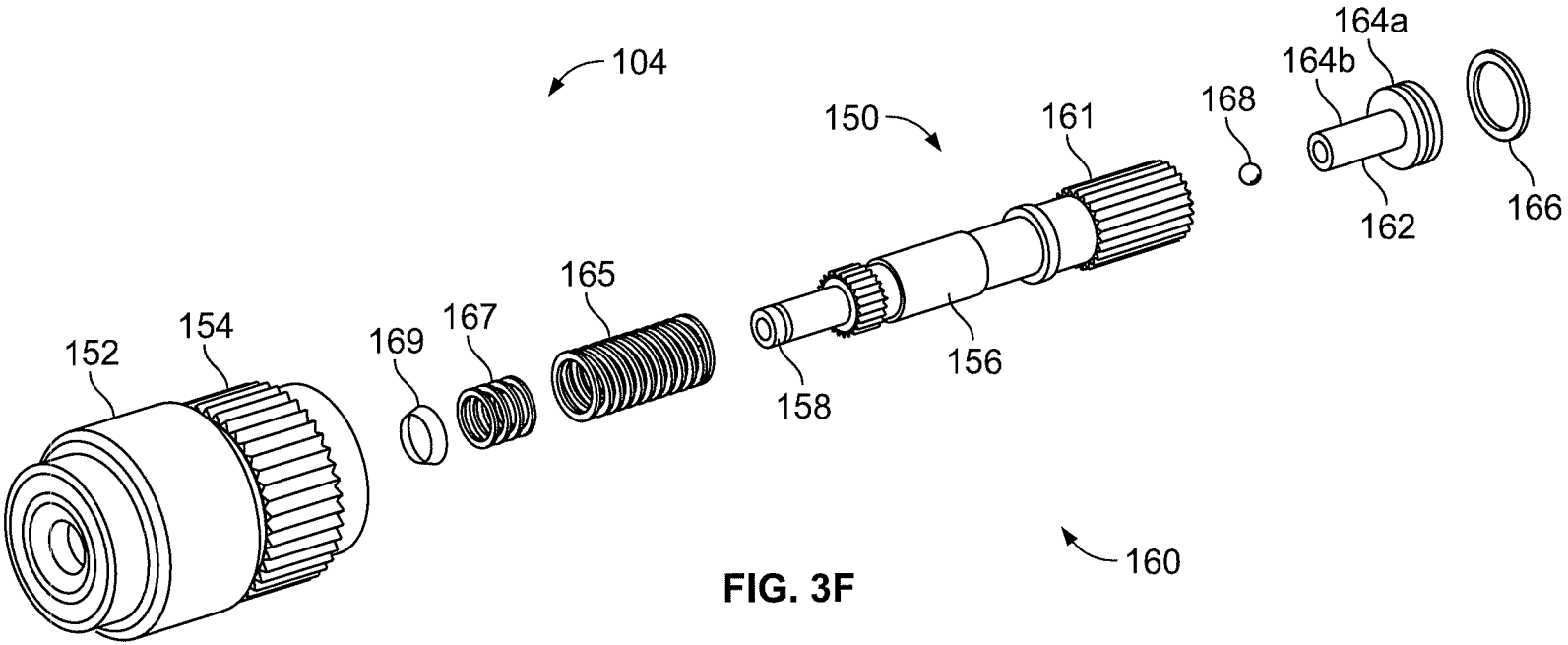
FIG. 3F illustrates an enlarged perspective view of the spindle assembly shown in FIG. 3A.

As shown by at least FIGS. 2, 3A, and 3F, in the illustrated embodiment, the spindle assembly 104 generally includes a spindle 150 extending generally along the second rotational axis $R_2$, and a plunger assembly 160 engaged with the spindle 150 and also arranged generally along the second rotational axis $R_2$.

The spindle 150 generally includes a clutch 152 and an drive shaft 156. The clutch 152 includes external splines or gear teeth 154 formed about an outer perimeter of the clutch 152 that intermeshingly engage with the multi-tooth gear 146*b* of the gear drive assembly 102. The drive shaft 156 is positioned within the clutch 152 and includes a distal end portion 158 that extends through an opening in the power transmission housing assembly 106. The spindle assembly 104 is rotationally supported within the blind opening 132 in the second mounting plate portion 130 of the mounting plate 108 via a first shaft bearing 159*a*, and within an opening in the power transmission housing assembly 106 via a second shaft bearing 159*b*. According to certain embodiments, the spindle assembly 104 may be configured to provide a gear reduction ratio between the clutch 152 and the drive shaft 156. However, in other embodiments, the drive shaft 156 may be directly coupled to the clutch 152 to provide 1:1 rotational movement therebetween.

The plunger assembly 160 generally includes a piston 162 having a head portion 164*a* and a stem portion 164*b*, an O-ring seal 166 extending about the head portion 164*a*, and a ball member 168 positioned adjacent the distal end of the stem portion 164*b*. The stem portion 164*b* of the piston 162 is configured for placement within an orifice of the drive shaft 156 so that the drive shaft 156 may be rotated about the stem portion 164*b* at least when the drive shaft 156 is in an engagement position, as discussed below.

According to the illustrated embodiment, the plunger assembly 160 also includes a return spring 165 and a pinion spring 167 that are positioned about outer surfaces of the drive shaft 156. According to the illustrated embodiment, the return spring 165 is configured to be positioned between a first shoulder 157*a* of the drive shaft 156 and an inner shoulder 153 of the clutch 152. Further, the pinion spring 167 may be positioned between a second shoulder 157*b* of the drive shaft 156 and a spring collar 169 that is operably attached to the drive shaft 156, such as, for example, by a retaining ring 187.

The plunger assembly 160 is configured to laterally displace the drive shaft 156 generally along the $R_2$ axis between a retracted position (as shown in FIG. 2) and an engagement position. According to certain embodiments, when the plunger assembly 160 and pinion gear 180 are in the retracted position, the pinion gear 180 is not engaged with a mating gear of the engine, such as, for example, a flywheel. When the pinion gear 180 is to engage a mating gear of the engine, a fluid, such as, for example, a compressed gas, may be delivered to the blind opening 132 of the second mount plate 130. For example, referencing FIGS. 3E and 5, the second mounting plate portion 130 may include inlet and outlet gas apertures 139*a*, 139*b* that are in fluid communication with the blind opening 132 of the second mount plate 130. Further, according to certain embodiments, the inlet and outlet gas apertures 139*a*, 139*b* may be configured for a mating engagement with a connector or fitting of a supply and/or outlet line or piping that is used to transport a pressurized gas to the second mount plate 130.

As pressurized gas is delivered to the blind opening 132 through the inlet aperture 139*a*, the pressure of the delivered gas may be sufficient to overcome the biasing force of at least the return spring 165, thereby causing at least the drive shaft 156 to be displaced toward the engagement position, wherein the pinion gear 180 engages a mating gear of the engine. Further, according to certain embodiments, with the drive shaft 156 displaced to the engagement position, gear teeth or splines 161 of the drive shaft 156 may be positioned to engage mating internal gear teeth/splines of the clutch 154, thereby allowing the rotational movement of the clutch 154 to drive the rotational displacement of the drive shaft 156, thereby causing the pinion gear 180 to drive the rotational movement of the mating engine gear. Additionally, the pinion spring 167 may be configured to assist in retaining the pinion gear 180 in the engagement position.

When the pinion gear 180 is to return from the engagement position to the retracted position, such as, for example, upon or after starting the engine, the pressure provided by the gas in the blind opening 132 may be reduced to a level at which the pressure no longer overcomes the biasing force of the return spring 165. According to the illustrated embodiment, pressure within the blind opening 132 may be reduced at least in part by the removal of the delivered fluid from the blind opening 132 through the outlet aperture 139*b*. The return spring 165 may then exert a force that laterally displaces the drive shaft 156 generally along the $R_2$ axis and back to its retracted position.

Although a particular type and configuration of the spindle assembly 104 is illustrated and described herein, it should be understood that other types and configurations of spindle assemblies are also contemplated for use in association with the air-powered starter motor 20.

Figure 3G:
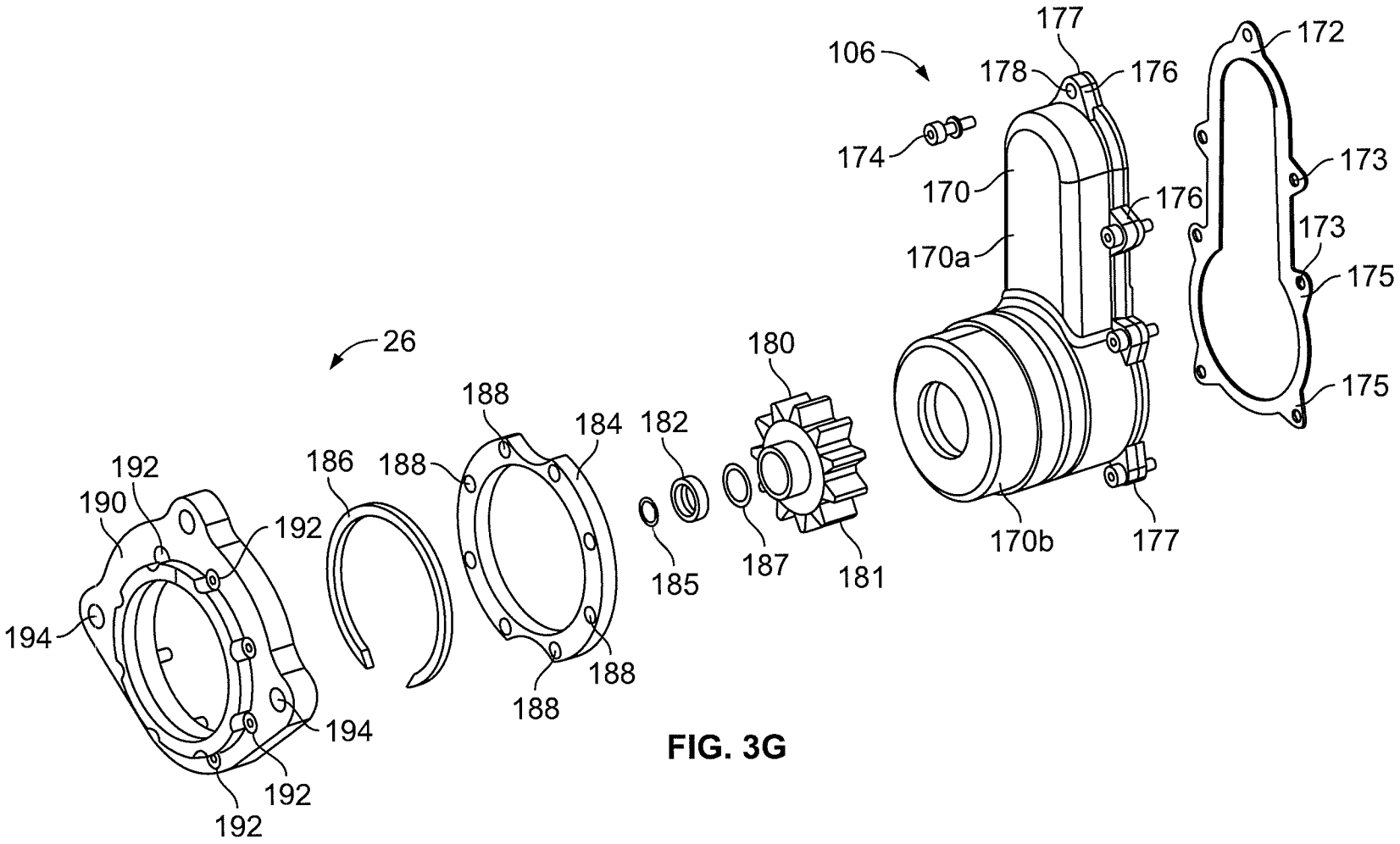
FIG. 3G illustrates an enlarged perspective view of the power transmission housing and engine interface assemblies shown in FIG. 3A.
Figure 6:
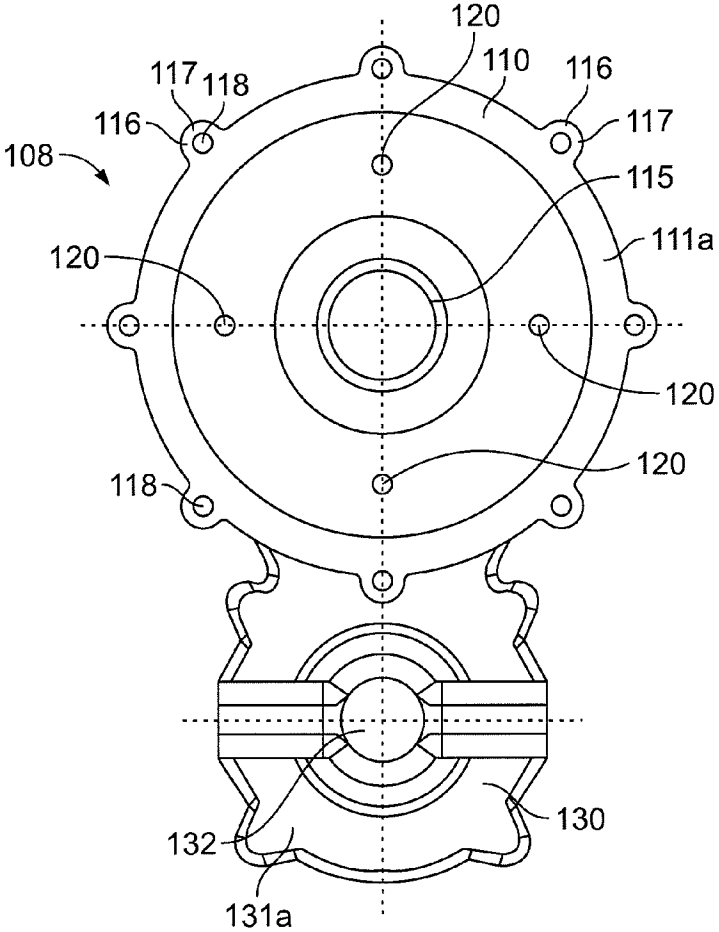
FIG. 6 illustrates an end view of the mounting plate shown in FIG. 5.
Figure 5:
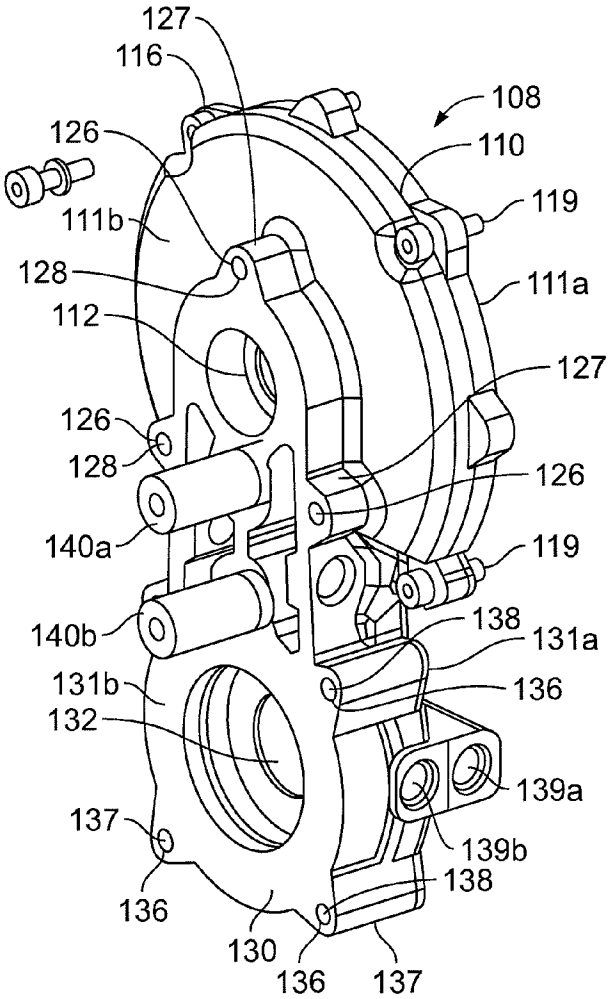
FIG. 5 illustrates an enlarged front perspective view of the mounting plate shown in FIG. 3A.

As shown by at least FIGS. 2, 3A, and 3G, in the illustrated embodiment, the power transmission housing assembly 106 generally includes a power transmission housing 170, a gasket or seal 172 positioned between the power transmission housing 170 and the mounting plate 108 to provide sealing engagement therebetween, and a plurality of pins, screws or fasteners 174 for attaching the power transmission housing 170 to the mounting plate 108.

The power transmission housing 170 includes a first housing portion 170*a* which encloses portions of the gear drive assembly 102, and a second housing portion 170*b* which encloses portions of the spindle assembly 104. The power transmission housing 170 further includes a number of attachment locations or nodes 176 formed about an outer perimeter of the housing 170. The attachment locations 176 are alignable with, and attachable to, corresponding attachment locations 126, 136 defined by the mounting plate 108 to securely attach the power transmission housing assembly 106 to the mounting plate assembly 100. According to certain embodiments, the attachment locations 176 each include an opening or aperture 178 sized to threadingly receive the fastener 174 therethrough for threading engagement within the opening 128, 138 defined by a corresponding one of the attachment location 126, 136 to securely attach the power transmission housing assembly 106 to the mounting plate assembly 100. In a further embodiment, each of the attachment locations 176 includes a radial flange or projection 177 defining one of the openings 178. In the illustrated embodiment, the power transmission housing 170 includes seven attachment locations 176. However, it should be understood that the power transmission housing 170 may be provided with any number of attachment locations 176. Additionally, although a particular configuration of the attachment locations 176 is illustrated and described herein, it should be understood that other types and configurations of attachment locations are also contemplated for use in association with the power transmission housing 170. The gasket 172 has a shape corresponding to the shape of the outer perimeter of the power transmission housing 170 and also includes a number of nodes 175 defining openings 173 extending therethrough for receiving the fasteners 174.

Although a particular type and configuration of the power transmission housing assembly 106 is illustrated and described herein, it should be understood that other types and configurations of power transmission housing assemblies are also contemplated for use in association with the air-powered starter motor 20.

Referencing at least FIGS. 2, 3A, and 3G, in the illustrated embodiment, the engine interface assembly 26 generally includes the pinion gear 180, a flange ring 184, and an engine mounting plate 190 that is attachable to the flange ring 184 and to the engine. According to certain embodiments, the pinion gear 180 includes gear teeth 181 that are configured for intermeshing engagement with gear teeth defined by a corresponding gear (not shown) associated with the engine. The pinion gear 180 is non-rotatably secured to the distal end portion 158 of the drive shaft 156 by any suitable means including, for example, by way of a collar 182 that is secured on drive shaft 156 by a retainer ring 185. More specifically, according to certain embodiments, the retainer ring 185 is configured to be positioned between a groove in the drive shaft 156 and a corresponding recess in an inner orifice of the collar 182 so as to secure the collar 182 to the drive shaft 156. Additionally, according to certain embodiments, the pinion gear 180 may be a modular component that may be replaced with another pinion gear so as to properly match the gear tooth size and gear tooth configuration of the mating gear of the engine.

According to certain embodiments, the flange ring 184 is configured as an annular ring that slips over the second housing portion 170*b* of the power transmission housing 170 and is secured thereto by way of a C-clip 186 that is positionable within an annular groove 171 formed about the second housing portion 170*b*. The flange ring 184 further defines a number of threaded openings 188 positioned about the perimeter of the flange ring 184.

According to certain embodiments, the engine mounting plate 190 is also configured to slip over the second housing portion 170*b* of the power transmission housing 170. The engine mounting plate 190 includes a first set of through openings 192 that are alignable with the threaded openings 188 of the flange ring 184, and a second set of through openings 194 that are positioned about an outer perimeter of the engine mounting plate 190. In the illustrated embodiment, the engine mounting plate 190 is secured to the flange ring 184 by way of a number of screws or fasteners 196 extending through the openings 194 and into threading engagement within the threaded openings 188 of the flange ring 184. As should be appreciated, the engine mounting plate 190 may be secured to the flange ring 184 at multiple angular orientations via the alignment of the openings 194 with different ones of the threaded openings 188. Additionally, the engine mounting plate 190 may be interchangeable with other modular engine mounting plates 190 that are designed to accommodate different engine configurations and mounts, thereby further enhancing the versatility of the starter motor 20. As should also be appreciated, the engine mounting plate 190 is attachable to the engine via a number of screws or fasteners (not shown) which pass through the openings 194 and into engagement with corresponding openings or apertures formed in the engine.

Although a particular type and configuration of the engine interface assembly 26 is illustrated and described herein, it should be understood that other types and configurations of engine interface assemblies are also contemplated for use in association with the air-powered starter motor 20.

Referencing FIGS. 7-11, the configuration of the starter motor 20 allows for adjustments to the orientation of at least the motor housing 40, and thus allows for positional changes to the locations of the air inlet and outlet 50, 54. For example, as shown in at least FIGS. 1, 7, and 8, and similarly in FIGS. 9-11, the motor housing 40 may be rotated generally about a first adjustment axis, which, according to certain embodiments, may be the first rotational axis $R_1$. Moreover, the motor housing 40 may be separated from at least the mounting plate 108 by removal of the associated fasteners 119. Such separation may allow the mounting pin 68 to vacate at a recess 120 of the mounting plate 108. With at least the motor housing 40 and mounting pin 68 separated from the mounting plate 108, the angular orientation of the motor housing 40, and more particular, the angular orientation of the air inlet and outlet 50, 54, may be adjusted about the first adjustment axis. For example, as illustrated in FIGS. 7 and 8, the motor housing 40 may be rotated about the first adjustment axis from a first angular position where the axes $L_1$ and $L_2$ of the air inlet and outlet 50, 54, respectively, generally extend in a first direction (as shown by "V" in FIG. 7), to a second angular position, where the axes $L_1$ and $L_2$ of the air inlet and outlet 50, 54 generally extend in a second direction (as shown by "L" in FIG. 8) that is generally perpendicular to the first direction.

Similarly, the angular orientation of at least a portion of the rotary actuator assembly 32, such as, for example, the stationary air motor liner 66 and the end plates 80, 84 in the illustrated embodiment, may also be rotably adjusted in accordance with the adjustments to the angular orientation of the motor housing 40. For example, when the angular orientation of the motor housing 40 is adjusted, the stationary air motor liner 66 may also be rotated so that openings 61 of the stationary air motor liner 66 remain aligned with the air inlet passage 53, while other openings 61 are aligned with the air outlet passages 57*a*, 57*b* of the motor housing 40. Additionally, according to certain embodiments, the angular orientation end plates 80, 84 may also be adjusted so that the end plates 80, 84 are operably positioned to receive insertion of the mounting pin 68.

The motor housing 40 and the rotary actuator assembly 32 are thus configured such that, regardless of the angular orientation of the housing 40 and rotary actuator assembly 32, when properly aligned together, pressurized gas received via the air inlet 50 is directed to the center of the rotary actuator assembly 32. Similarly, regardless of the angular position of the motor housing 40, the motor housing 40 is designed such that expanded gas that is to be released from the motor housing 40 may exit via an opening 61 in the air motor liner 66 and pass to the outlet passages 57*a*, 57*b* and through the air outlet port 56. Thus, embodiments of the present invention provide a rotary actuator assembly 32 configuration that may be orientated about the first adjustment axis in a number of different positions and still remain able to insure that the radial vanes 72, when at rest, are suitably situated for providing consistent positive starting.

When adjustment of the motor housing 40 and the rotary actuator assembly 32 is complete, the mounting pin 68 may, if removed, be reinserted into the stationary air motor liner 66 and end plates 80, 84, and repositioned in an adjacent aperture 118 in the mounting plate 108. Further, the end cover 90, if separated from the motor housing 40 and/or mounting pin 68, may be aligned so that the mounting pin 68 is positioned in the indentation 95 of the end cover 90. The motor housing 40 may then be secured to the mounting plate 108 and, if needed, the end cover 90 via the associated fasteners 99, 119 being inserted through apertures 98, 118 in the end cover 90 and mounting plate 108 and into adjacent the openings 48 in the motor housing 40.

Additionally, the motor housing 40 may also be rotated between first and second side positions about a second adjustment axis, as indicated, for example, by a third rotational axis $R_3$ in FIG. 4, that is generally perpendicular to and intersects the first rotational axis $R_1$. For example, with the motor housing 40 and mounting pin 68 separated from the end cover 90 and the mounting plate 108, the motor housing 40 may be removed from engagement with the rotary actuator assembly 32 and rotated from a first side position, in which the first side 44*a* of the motor housing 40 is adjacent to the mounting plate 108, to a second side position, in which the first side 44*a* is adjacent to the end cover 90. Comparing FIGS. 7 and 10, for example, the ability to adjust the motor housing 40 between first and second side positions may provide the ability to alter which side of the starter motor 20 the air inlet 50 is positioned when the axis $L_2$ of the outlet port 54 is generally in a vertical orientation. Similar exemplary comparisons are also provided by FIGS. 8 and 9 and FIGS. 1 and 11, which show the axis $L_2$ of the outlet port 54 generally in a lateral orientation and the air inlet 50 on opposite sides of the motor housing 40. Additionally, as previously discussed, the air inlet 50 is designed to allow for access from both sides of the inlet 50 via inlet ports 52*a*, 52*b*. Thus, the ability to adjust the orientation of the motor housing 40 between first and second side positions, in addition to the ability to adjust the angular position about the first adjustment axis may increase, and, according to certain embodiments, may double the number of configurations of the air-powered starter motor 20. According to the illustrated embodiment, the motor housing 40 may be secured at the first or second side position by repositioning the rotary actuator assembly 32 within the motor housing 40 and reattaching or connecting the motor housing 40 and mounting pin 68 to the mounting plate 108 and the end cover 90.

Various features and advantages of the present invention are set forth in the following claims. Additionally, changes and modifications to the described embodiments described herein will be apparent to those skilled in the art, and such changes and modifications can be made without departing from the spirit and scope of the present invention and without diminishing its intended advantages. While the present invention is illustrated and described in detail in the drawings and foregoing description, the same is to be considered illustrative and not restrictive in character, it being understood that only selected embodiments have been shown and described and that all changes, equivalents, and modifications that come within the scope of the inventions described herein or defined by the following claims are desired to be protected.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. An air-powered starter motor comprising:

A motor housing having a sidewall, a first side, and a second side, said sidewall generally defining an interior region of said motor housing:

an air motor liner having a plurality of mounting pin alignment openings formed therein;

an air motor and the air motor liner positioned within said interior region and mounted for rotation about a rotational axis:

a mounting structure configured for selective attachment to one of said first and second sides of said motor housing; and wherein the air-powered starter motor includes a first operational configuration wherein said mounting structure is attached to said first side of said motor housing, and a second operational configuration wherein said mounting structure is attached to said second side of said motor housing.

2. The air-powered starter motor of claim 1, wherein said motor housing is configured to allow for adjustable attachment of said motor housing to said mounting structure at a plurality of angular orientations relative to said rotational axis, and wherein said first operational configuration includes attachment of said motor housing to said mounting structure at one of said plurality of angular orientations.

3. The air-powered starter motor of claim 2, wherein said second operational configuration includes attachment of said motor housing to said mounting structure at one of said plurality of angular orientations.

4. The air-powered starter motor of claim 3, wherein, at least one of said plurality of angular orientations is generally perpendicular to another of said plurality of angular orientations.

5. The air-powered starter motor of claim 3, wherein, said motor housing further includes an air inlet having a first air inlet port and a second air inlet port, said first and second air inlet ports being positioned generally along a first lateral axis of said air inlet and at opposing ends of said air inlet, said first and second air inlet ports being in fluid communication with said interior region.

6. The air-powered starter motor of claim 5, wherein said motor housing further includes an air outlet port positioned generally along a second lateral axis, said second lateral axis being generally parallel to and offset from said first lateral axis, said air outlet ort being in fluid communication with said interior region.

7. The air-powered starter motor of claim 6, wherein the air motor liner includes a sidewall configured for said air motor liner to be placed within said interior region of said motor housing, said sidewall of said air motor liner having a plurality of openings, at least one of said plurality of openings being in fluid communication with said air inlet and at least another of said plurality of openings being in fluid communication with said air outlet port.

8. An air-powered starter motor comprising;

a motor housing having a sidewall, a first side, and a second side, said sidewall generally defining an interior region of said motor housing;

an air motor liner having a mounting pin alignment opening formed therein;

an air motor and the air motor liner positioned within said interior region and mounted for rotation about a rotational axis;

a mounting structure configured for selective attachment to said motor housing, said motor housing configured for adjustable attachment at either side thereof to said mounting structure at a plurality of angular orientations relative to said rotational axis; and wherein the air-powered starter motor includes a plurality of operational configurations, the angular orientation at which said motor housing is attached to said mounting structure being different for each of said plurality of operational configurations.

9. The air-powered starter motor of claim 8, wherein said mounting structure comprises a portion of an engine.

10. The air-powered starter motor of claim 8, wherein, at least one of sa id plurality of angular orientations is generally perpendicular to another of said plurality of angular orientations.

11. The air-powered starter motor of claim 8, wherein said motor housing further includes an air inlet including a sleeve having a first air inlet port and a second air inlet port, said first and second air inlet ports being positioned generally along a first lateral axis of said air inlet at opposing ends of said sleeve, said first and second air inlet ports being in fluid communication with said interior region.

12. The air-powered starter motor of claim 11, wherein said motor housing further includes an air outlet port positioned generally along a second lateral axis, said second lateral axis being generally parallel to and offset from said first lateral axis, said air outlet port being in fluid communication with said interior design.

13. The air-powered start motor of claim 12, wherein the air motor liner includes a sidewall configured for said air motor liner to be placed within said interior region of said motor housing, said sidewall of said air motor liner having a plurality of openings, at least one of said plurality of openings being in fluid communication with said air inlet and at least another of said plurality of openings being in fluid communication with said air outlet port.

14. An air-powered starter motor comprising:

a motor housing having a sidewall, a first side, and a second side, said sidewall generally defining an interior region of said motor housing;

a rotary actuator assembly having a rotary air motor, an air motor liner, and a mounting pin engageable with an alignment opening in the air motor liner, said air motor liner having a sidewall configured for placement within said interior region and for said air motor liner to receive insertion of at least a portion of said rotary air motor, said sidewall of said air motor liner having a plurality of openings, said rotary air motor configured for rotation about a rotational axis;

a mounting structure configured for selective attachment to said motor housing, said motor housing configured for adjustable attachment to said mounting structure at a plurality of angular orientations relative to said rotational axis; and wherein the air-powered starter motor includes a plurality of operational configurations, the angular orientation at which said motor housing is attached to said mounting structure being difference for each of said plurality of operational configurations and wherein said mounting pin is configured to align and interconnect said rotary actuator assembly with said mounting structure for each of said plurality of operational configurations, and wherein said mounting structure is further configured for selective attachment to one of said first and second sides of said motor housing.

15. The air-powered starter motor of claim 14, wherein said mounting structure includes a plurality of recesses configured to selectively receive a portion of said mounting pin.

16. The air-powered starter motor of claim 15, further including an end cover for attachment to said motor housing, said end cover including an indentation sized for receipt of an end portion of said mounting pin to align and interconnect said end cover with said rotary actuator assembly and said mounting structure.

17. The air-powered starter motor of claim 15, wherein said motor housing further includes an air inlet including a sleeve having a first air inlet port and a second air inlet port, said first and second air inlet ports being positioned generally along a first lateral axis of said air inlet and at opposing ends of said sleeve, said first and second air inlet ports facing outward from each of the ends of the sleeve, respectively.

18. The air-powered starter motor of claim 17, wherein said motor housing further includes an air outlet port positioned generally along a second lateral axis, said second lateral axis being generally parallel to and offset from said first lateral axis, said air outlet port being in fluid communication with said interior region.

19. The air-powered starter motor of claim 18, wherein at least one of said plurality of openings of said sidewall of said air motor liner are in fluid communication with said air inlet, at least another of said plurality of openings are in fluid communication with said air outlet port.

20. The air-powered starter motor of claim 5, further comprising a removable plug configured to selectively engage within one of the first air inlet port or the second air inlet port to prevent a flow of fluid therethrough.

21. The air-powered starter motor of claim 5, wherein the inlet includes an elongate hollow sleeve extending between the first and second air inlet ports.

* * * * *